United States Patent [19]

Bixler

[11] 4,383,638

[45] May 17, 1983

[54] CARTON LOCK

[75] Inventor: Kenneth D. Bixler, Huntington, N.Y.

[73] Assignee: Diamond International Corporation, New York, N.Y.

[21] Appl. No.: 306,982

[22] Filed: Sep. 29, 1981

[51] Int. Cl.[3] ..... B65D 85/32; B65D 5/66

[52] U.S. Cl. ..... 229/45 EC; 229/2.5 EC; 229/44 EC

[58] Field of Search ..... 229/2.5 EC, 45 EC, 44 EC

[56] References Cited

U.S. PATENT DOCUMENTS

| | | | |
|---|---|---|---|
| 3,217,963 | 11/1965 | Alsman | 229/2.5 EC |
| 3,258,186 | 6/1966 | Greatman | 229/2.5 EC |
| 3,276,656 | 10/1966 | Hartmann | 229/2.5 EC |
| 3,459,360 | 8/1969 | Bagay | 229/45 EC |
| 3,471,078 | 10/1969 | Seest | 229/44 EC |

*Primary Examiner*—Herbert F. Ross

*Attorney, Agent, or Firm*—Sheridan Neimark; Karl W. Flocks

[57] ABSTRACT

A beak type lock for a container includes an upstanding latching member having a horizontal rib at its latching surface and vertical rib extending upwardly therefrom, which latching member is adapted to engage an orifice having a shoulder at its bottom margin and a recessed upper margin and wherein the shoulder is ribbed on its under side.

8 Claims, 15 Drawing Figures

CARTON LOCK

BACKGROUND OF THE INVENTION

This invention relates to new and improved latching formation for molded containers and cartons. More particularly it relates to beak type locks of improved form which are stronger than prior structures.

In the past, the carton designers of molded cartons have produced cartons with beak type locks. However, such prior designs and constructions have relatively weak engaging surfaces and are subject to rupture and failure when opening is attempted. In some instances the beak fails and in other instances the orifice wall ruptures. The problem of failure and rupture was ever present in prior constructions. Although, over the years, many good designers attempted to produce improved locks, failures and ruptures still occurred and the problem was not completely solved.

Examples of prior designs appear in the U.S. Pat. Nos. to Alsman, 3,217,963; Friday, 3,245,600; Hartman, 3,276,656; and Seest et al, 3,471,078. In each of these prior designs, developed over the years, and with practical experience, the orifice engaging surface remained simple, Seest et al attempted to reinforce their beak with a horizontal rib at the very top thereof away from the latch engaging surface. It was not obvious to any of the prior workers in the field to provide a horizontal peripheral rib at the engaging surface or a vertical rib extending upwardly therefrom.

The molded containers and cartons on which the latching formation in accordance with the instant invention is useful include egg cartons, food containers such as boxes for sandwiches, chicken parts, pizzas, and hamburgers in fast food operations, and other food articles and other items.

SUMMARY OF THE INVENTION

In accordance with the invention, molded cartons are provided with strong locks including an upstanding latching member on a lower portion or tray adapted to engage the lower margin of an orifice in the front wall of a cover.

In this Specification of the invention the latching member is also referred to as a beak and as a beak-lock and in some embodiments as a cobra or cobra lock, particularly as latching member is provided with a horizontal peripheral rib at the latching surface which engages the lower margin of the orifice in the cover front wall.

It is an object of the invention to provide a strong beak-lock molded with a horizontal peripheral rib at its orifice engaging surface.

It is a further object of the invention to provide a strong beak-lock with one or more vertical ribs extending upwardly from its orifice engaging surface.

It is another object of the invention to provide a strong beak-lock with a wide horizontal peripheral rib having an overall width which is of greater dimension than the height of the beak portion of the latching member.

Another object is to provide an improved orifice in the front wall of the carton which will have a shoulder associated with the lower margin thereof.

It is an object to provide an improved orifice having a shoulder at its lower margin formed with one or more recesses.

Another object is to provide an improved orifice having its upper margin recessed with respect to its side and bottom margins.

DETAILED DESCRIPTION OF THE INVENTION

Figure 1:
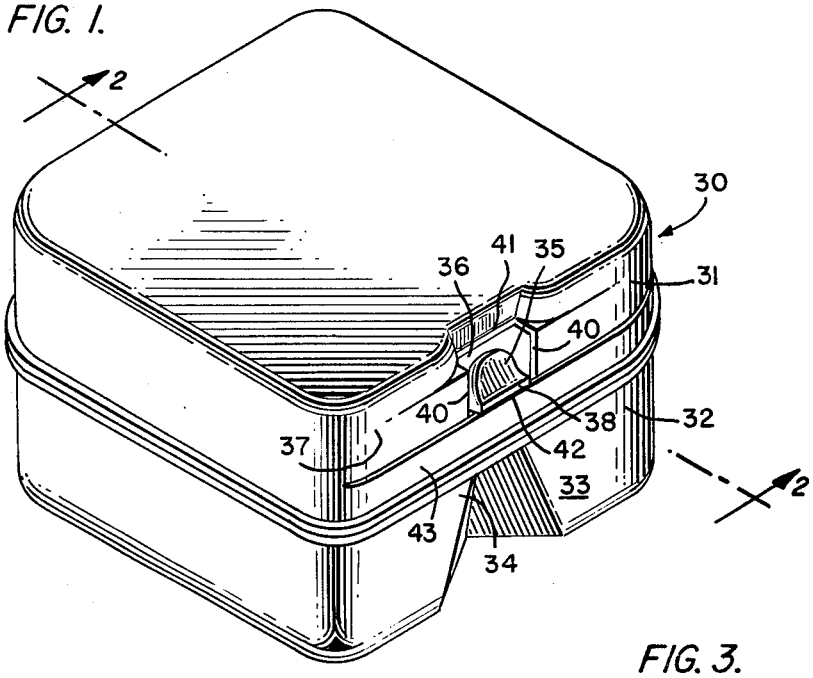
FIG. 1 is a view in perspective of a closed box or container or carton illustrating the latch which extends upwardly from the front wall of the tray or bottom of the carton through the orifice or opening in the front wall of the cover thereof.

Referring to the drawings and more particularly to FIGS. 1, 2, 12, 13, and 14, the carton 30 includes an upper cover 31 and a lower tray 32 which is hingedly connected at its rear to the cover 31. Front wall 33 of the tray 32 is recessed inwardly at 34 and has upwardly extending therefrom a latching member 35 in the form of a beak or a beak-lock and in some embodiments it is described as a cobra or cobra lock. This latching member may also be described as a male latching member and is adapted to cooperate with an orifice or female latching formation 36 molded in the front wall 37 of the cover 31. The beak 35 is substantially hollow and has sidewalls which taper downwardly and outwardly to an integral horizontal peripheral rib or flange 38.

The orifice 36 has a lower margin formed as a shoulder 42 with which the lowermost surface of the beak 35 is adapted to engage. The two side margins 40 of the orifice 36, and the lower margin formed as shoulder 42 are generally in the same plane. The upper margin 41 of the orifice 36 is recessed inwardly. On a level with the lower margin of the orifice 36 formed as shoulder 42, at least a portion of the horizontal peripheral rib 38 of the beak 35 extends thereover when the beak 35 is in latching engagement. Formed integrally with the shoulder 42 is the depending band 43 which may be recessed at the location where the lowermost portion of the beak engages the lower margin of the orifice or shoulder 42 and serves to enhance the effectiveness of the locking engagement.

Figure 3:
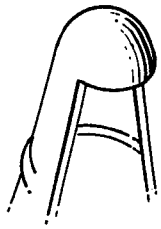
FIG. 3 is a fragmentary perspective view of a prior art latch or beak-lock which is subject to rupture when opening the carton with which the lock is associated.
Figure 2:
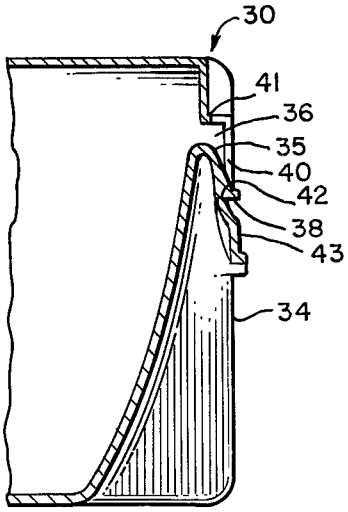
FIG. 2 is a vertical section through the box or container or carton taken along line 2—2 of FIG. 1 and looking in the direction of the arrows.
Figure 4:
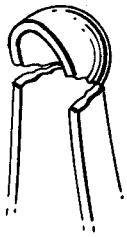
FIG. 4 is a view similar to FIG. 3 of a prior art latch which has ruptured upon opening of the carton.

FIG. 3 discloses a typical prior art latching member or beak which is subject to rupture as illustrated in FIG. 4 when one attempt or repeated attempts are made to open a carton incorporating this type of conventional beak and these illustrations serve to point out the novelty and advantages of the construction in accordance with the instant invention.

Figure 5:
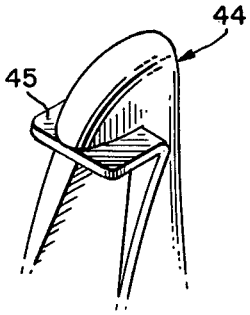
FIG. 5 is a fragmentary perspective view of a modified latch or beak-lock which resembles a cobra and may be called a cobra lock and is useful when a wider latch is desired or required.

FIG. 5 discloses another embodiment of beak lock 44, in accordance with the invention in which the horizontal peripheral rib 45 is of relatively wide dimension and wherein the width of the beak-lock latching member is of greater dimension than the height of the beak taken from its plane of engagement to the very top thereof.

Figure 6:
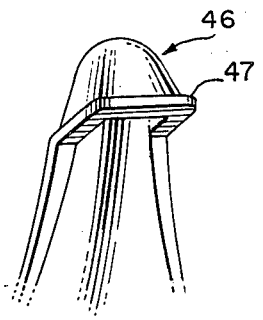
FIG. 6 is a fragmentary view in perspective similar to FIG. 5 of a further modified beak-lock showing the differently proportioned horizontal rib at the latching surface at the front and also at the sides of the beak.

FIG. 6 illustrates another embodiment 46 wherein the horizontal peripheral rib 47 is of different proportions than that illustrated in FIG. 5 and extends along the front of the beak and rearwardly along the sides of the beak.

Figure 7:
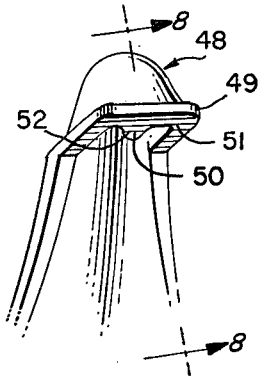
FIG. 7 is a view similar to FIG. 6 and showing the lower end surface of the vertical rib at the front of the beak.
Figure 8:
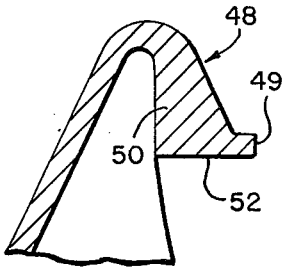
FIG. 8 is a vertical section taken along line 8—8 of FIG. 7 and looking in the direction of the arrows and illustrating the solid vertical rib at the front of the beak.

FIGS. 7 and 8 illustrate still another modified form of the beak lock or male latching member 48 in which the horizontal peripheral rib 49 extends along the front of the beak and around the sides of the beak and wherein the front of the beak is provided with a substantially vertical rib 50 which extends from the interior top of the hollow beak 48 to a horizontal plane which passes through the rib 49 so that the latch engagement surface not only includes the lower surface 51 of the rib 49 but also includes the lower surface 52 of the rib 50.

Figure 9:
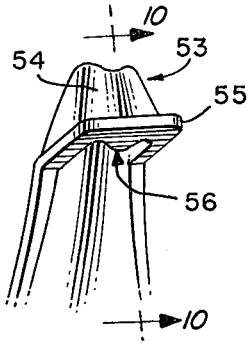
FIG. 9 is a view similar to FIG. 6 illustrating a further modified form in which the front of the horizontally ribbed beak is recessed to strengthen the beak.
Figure 10:
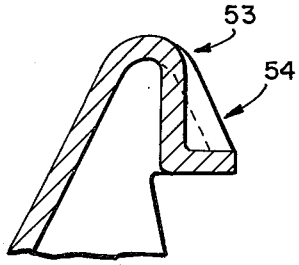
FIG. 10 is a vertical section taken along line 10—10 of FIG. 9.

FIGS. 9 and 10 show still another embodiment 53 of the beak in accordance with the instant invention wherein the front surface 54 of the beak is concave in the form of a channel-like structure extending upwardly to the top of said beak and the horizontal peripheral rib 55 has a lower surface 56 which forms an engagement shoulder extending inwardly.

Figure 11:
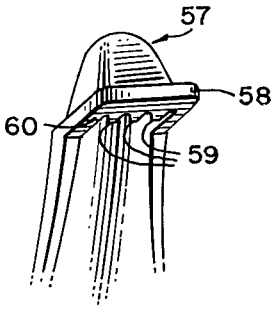
FIG. 11 is a view similar to FIG. 7 showing a modified form with three vertical ribs in the beak.
Figure 12:
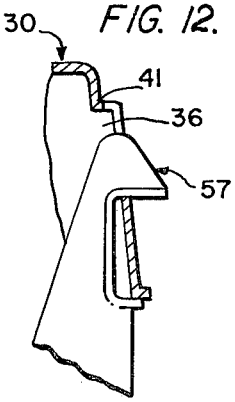
FIG. 12 is a fragmentary view showing the beak-lock 57 in elevation and a cover portion in vertical section taken at the orifice or opening in the cover.
Figure 13:
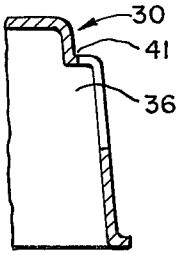
FIG. 13 is a view similar to FIG. 12 showing the cover portion at the orifice or opening before it is engaged by the beak-lock.
Figure 14:
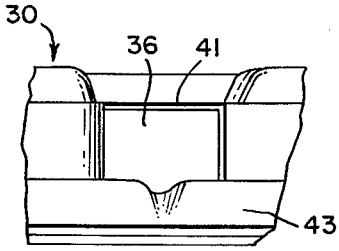
FIG. 14 is a fragmentary perspective view of the orifice in the cover modified to include a recess at the front of a shoulder therebelow.

FIG. 11 is still another embodiment 57 of a beak in accordance with the instant invention wherein the horizontal peripheral rib 58 is formed integrally with three vertically extending ribs 59. The ribs 59 extend upwardly from the lower surface 60 of the horizontal peripheral rib 58 into the top of hollow beak 57.

Figure 15:
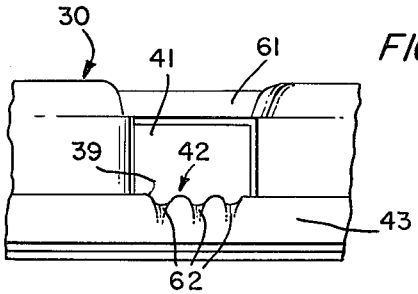
FIG. 15 is a view similar to FIG. 14 of a further modification illustrating three recesses in the shoulder below the orifice.

FIG. 15 is another embodiment 61 of an orifice formation. This embodiment is similar to the orifice illustrated in FIG. 1 but includes three indentations 62 in the shoulder 42 and the band 43. Viewed from the underside, these indentations 62 are in the shape of ribs and serve to reinforce the lower margin 39 of the opening 41 in this embodiment.

It will be understood that in accordance with the instant invention novel forms of beak-locks have been described which include latching engagement surfaces of particular formation which will resist tearing stresses and other forces encountered during closing and opening operations which may be manual or automatic. Also in accordance with the invention the latching engagement surface associated with the orifice with which the beak-lock engages have been particularly formed so as to obviate failure due to rupture when the containers or cartons incorporating the lock are opened or closed.

It will be obvious to those skilled in the art that various changes may be made without departing from the scope of the invention and the invention is not to be considered limited to what is shown in the drawings and described in the specification.

What is claimed is:

1. In a molded container having a lower tray section and an upper cover section hingedly connected to said tray section, said tray section having at least one upstanding male latching member formed on the front side thereof, said cover section having an orifice or female latching formation molded in the front side thereof, said container being further characterized in that the upstanding member includes a substantially hollow formation having side walls which taper outwardly and downwardly to an integral peripheral rib or flange.

2. The structure recited in claim 1 further characterized in that said upstanding latching member is provided on its interior with a generally vertical rib extending to and merging with said peripheral rib or flange.

3. The structure recited in claim 1 further characterized in that said upstanding latching member is provided on its interior with a plurality of generally vertical ribs extending to and merging with said peripheral rib or flange.

4. The structure recited in claims 1 or 2 or 3 and further characterized in that the width of said upstanding male latching member including its peripheral rib or flange is greater than its height measured from the bottom of said peripheral rib or flange to the uppermost point of said male latching member.

5. The structure recited in claim 1 further characterized in that the front side of said cover has a peripheral band formed with a shoulder located immediately at or below the said orifice or female latching formation, said shoulder, immediately below said orifice, including a rib formed on its underside.

6. The structure recited in claim 1 further characterized in that the front side of said cover has a peripheral band formed with a shoulder located immediately at or below the said orifice or female latching formation, said shoulder, immediately below said orifice including a plurality of ribs formed on its underside.

7. The structure recited in claim 1, further characterized in that said orifice is generally rectangular with two side margins and a lower margin being generally in the same plane and the upper margin thereof being relatively recessed.

8. The structure recited in claim 1, further characterized in that said hollow formation is formed with a channel-like concavity or depression on the exterior front wall thereof and extending upwardly from said peripheral rib substantially to the top of said hollow formation.

* * * * *